US008137131B2

(12) United States Patent
Wang et al.

(10) Patent No.: US 8,137,131 B2
(45) Date of Patent: Mar. 20, 2012

(54) SUPPORT FOR ELECTRICAL CONNECTOR

(75) Inventors: Po Win Wang, Taoyuan (TW); Chun Hsiang Fu, Taoyuan (TW)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/599,581

(22) PCT Filed: May 6, 2008

(86) PCT No.: PCT/IB2008/002397

§ 371 (c)(1),
(2), (4) Date: Apr. 15, 2010

(87) PCT Pub. No.: WO2008/152520

PCT Pub. Date: Dec. 18, 2008

(65) Prior Publication Data

US 2010/0216338 A1 Aug. 26, 2010

Related U.S. Application Data

(60) Provisional application No. 60/928,552, filed on May 10, 2007, provisional application No. 60/934,253, filed on Jun. 12, 2007.

(51) Int. Cl.
*H01R 13/60* (2006.01)

(52) U.S. Cl. ..... 439/570; 439/607.35

(58) Field of Classification Search ..... 439/570, 439/607.37, 571, 572, 567, 566, 607.27, 439/607.35–607.4, 135, 940

See application file for complete search history.

(56) References Cited

U.S. PATENT DOCUMENTS

| | | | | |
|---|---|---|---|---|
| 4,396,245 | A * | 8/1983 | Lane | 439/148 |
| 5,026,295 | A * | 6/1991 | Fong et al. | 439/135 |
| 5,104,326 | A | 4/1992 | Smith et al. | |
| 5,178,557 | A * | 1/1993 | Hashiguchi | 439/357 |
| 5,228,873 | A | 7/1993 | Hirai | |
| 5,281,166 | A * | 1/1994 | Yu et al. | 439/571 |
| 5,334,049 | A | 8/1994 | Kachlic et al. | |
| 5,603,639 | A * | 2/1997 | Lai et al. | 439/607.31 |
| 5,681,174 | A * | 10/1997 | Correll et al. | 439/135 |
| 5,807,135 | A * | 9/1998 | Clark | 439/567 |
| 5,865,645 | A | 2/1999 | Embo et al. | |
| 5,947,769 | A | 9/1999 | Leonard et al. | |
| 6,024,603 | A | 2/2000 | Chen et al. | |
| 6,077,115 | A * | 6/2000 | Yang et al. | 439/567 |

(Continued)

FOREIGN PATENT DOCUMENTS

JP 1234789 S 4/2005

*Primary Examiner* — Neil Abrams
*Assistant Examiner* — Harshad Patel
(74) *Attorney, Agent, or Firm* — Woodcock Washburn LLP

(57) ABSTRACT

A connector assembly is provided including an HDMI connector having a housing and a plurality of electrical contacts extending through the housing. The contacts define a first terminal end extending out from the housing and configured to be connected to electrical traces of a printed circuit board, and a second terminal end disposed opposite the first terminal end. The second end of the contacts can extend from the housing, and thereby be exposed to the ambient environment. The assembly can include one or more support mounts capable of attaching to the housing and to the circuit board to stabilize the connector. A protective shell can surround the second end of the contacts, and can be connected to the housing and to the printed circuit board. A dust cover can cover the upper end of the protective shell.

19 Claims, 9 Drawing Sheets

U.S. PATENT DOCUMENTS

| | | | | |
|---|---|---|---|---|
| 6,159,023 | A | 12/2000 | Lai | |
| 6,179,630 | B1 | 1/2001 | Chang | |
| 6,183,294 | B1 * | 2/2001 | Fan et al. | 439/567 |
| 6,203,374 | B1 * | 3/2001 | Huang et al. | 439/607.4 |
| 6,305,953 | B1 | 10/2001 | Shi et al. | |
| 6,371,776 | B1 * | 4/2002 | Li et al. | 439/135 |
| 6,375,498 | B1 | 4/2002 | Yu et al. | |
| 6,379,181 | B1 * | 4/2002 | Chang et al. | 439/567 |
| 6,386,910 | B1 | 5/2002 | Yu | |
| 6,500,028 | B1 * | 12/2002 | Higuchi | 439/607.37 |
| 6,579,122 | B1 * | 6/2003 | Chen | 439/570 |
| 6,755,671 | B1 * | 6/2004 | Fan et al. | 439/108 |
| 6,837,722 | B2 * | 1/2005 | Sakamoto | 439/135 |
| 6,986,681 | B2 | 1/2006 | Tsai | |
| 7,077,668 | B2 | 7/2006 | Lapidot et al. | |
| 7,090,540 | B2 | 8/2006 | Masumoto et al. | |
| 7,108,554 | B2 * | 9/2006 | Huang | 439/607.01 |
| 7,232,338 | B2 * | 6/2007 | Shen et al. | 439/571 |
| 7,331,822 | B2 * | 2/2008 | Chen n | 439/607.01 |
| 7,393,219 | B2 * | 7/2008 | Liao | 439/135 |
| 7,670,174 | B2 * | 3/2010 | Yuan et al. | 439/570 |
| 7,789,702 | B1 * | 9/2010 | Xiang et al. | 439/567 |
| 2004/0219830 | A1 * | 11/2004 | Fan | 439/570 |
| 2005/0026501 | A1 * | 2/2005 | Zhan et al. | 439/607 |
| 2006/0276064 | A1 | 12/2006 | Takimura et al. | |
| 2007/0015415 | A1 | 1/2007 | Yang | |
| 2007/0049072 | A1 | 3/2007 | Sato | |
| 2007/0066115 | A1 | 3/2007 | Saito et al. | |
| 2007/0082554 | A1 | 4/2007 | Saito | |
| 2007/0099512 | A1 | 5/2007 | Sato | |

* cited by examiner

SUPPORT FOR ELECTRICAL CONNECTOR

CROSS-REFERENCE TO RELATED APPLICATIONS

This application is the National Stage of International Application No. PCT/IB2008/002397, filed May 6, 2008, which claims the benefit of U.S. Provisional Application No. 60/928,552, filed May 10, 2007, and U.S. Provisional Application No. 60/934,253, filed Jun. 12, 2007, the disclosures of which are incorporated herein by reference in their entirety.

BACKGROUND

The present invention generally relates to High-Definition Multimedia Interface (HDMI) connectors, and in particular relates to an HDMI receptacle connector assembly having one or more support structures for mounting to an electrical component.

Electrical connectors are widely used to facilitate connections between electrical components or systems. Depending on the desired arrangement, connectors can be disposed in an orientation that causes them to be unevenly balanced. As one example, high definition multimedia interface (HDMI) connectors can be oriented vertically, thereby causing them to be top heavy and subject to damage. Specifically, conventional unevenly balanced or top heavy connectors were susceptible to damage that could result in, for instance, the connectors toppled over before or during electrical connection to a printed circuit board. Additionally, the use of solder joints that connect electrical connectors to PCBs has become prevalent due to the low profile and reliable electrical connections. Unfortunately, top heaviness or uneven balancing of connectors tend to induce strain on the solder joints, thus increasing the possibility of joint failure over time.

Attempts have been made to address the problems associated with top heavy or unevenly balanced connectors. For instance, referring to FIG. 1, a vertically oriented connector 20 is presented in combination with a protective bracket 22. The bracket includes a central body portion 24 wrapped around the connector 20, and a pair of laterally spaced downwardly extending legs 26 that are connected to the central body portion 24. The legs 26 are intended to fit into complementary mounting holes extending into a PCB. Unfortunately, the bracket may easily bend when handling or transporting the connector, thereby causing the legs 26 to break off or bend. Attempts to unbend the legs 26 can cause imprecise alignment with PCB mounting holes, or can cause the legs to break off altogether. Further, unbending the legs 26 may weaken the bracket 20 and thus preventing the bracket from stabilizing the HDMI connector.

What is therefore needed is a protective bracket configured to stabilize an HDMI connector, and that can provide support for the legs that attach to the connector/PCB assembly.

SUMMARY

In one aspect, the present invention provides a High-Definition Multimedia Face (HDMI) electrical connector assembly that can include a dielectric housing, and a plurality of electrical contacts extending through the housing. The electrical contacts can have a first terminal end extending out from the housing and configured to engage electrical traces of an electrical component, and a second terminal end extending out from the housing. A support mount can be mounted onto the housing, and is configured to mate with an engagement member carried by the housing. The support mount can include at least one support mount attachment member configured to attach to the electrical component when the first terminal end of the electrical contacts is connected to the traces of the electrical component.

DETAILED DESCRIPTION OF ILLUSTRATIVE EMBODIMENTS

Figure 1:
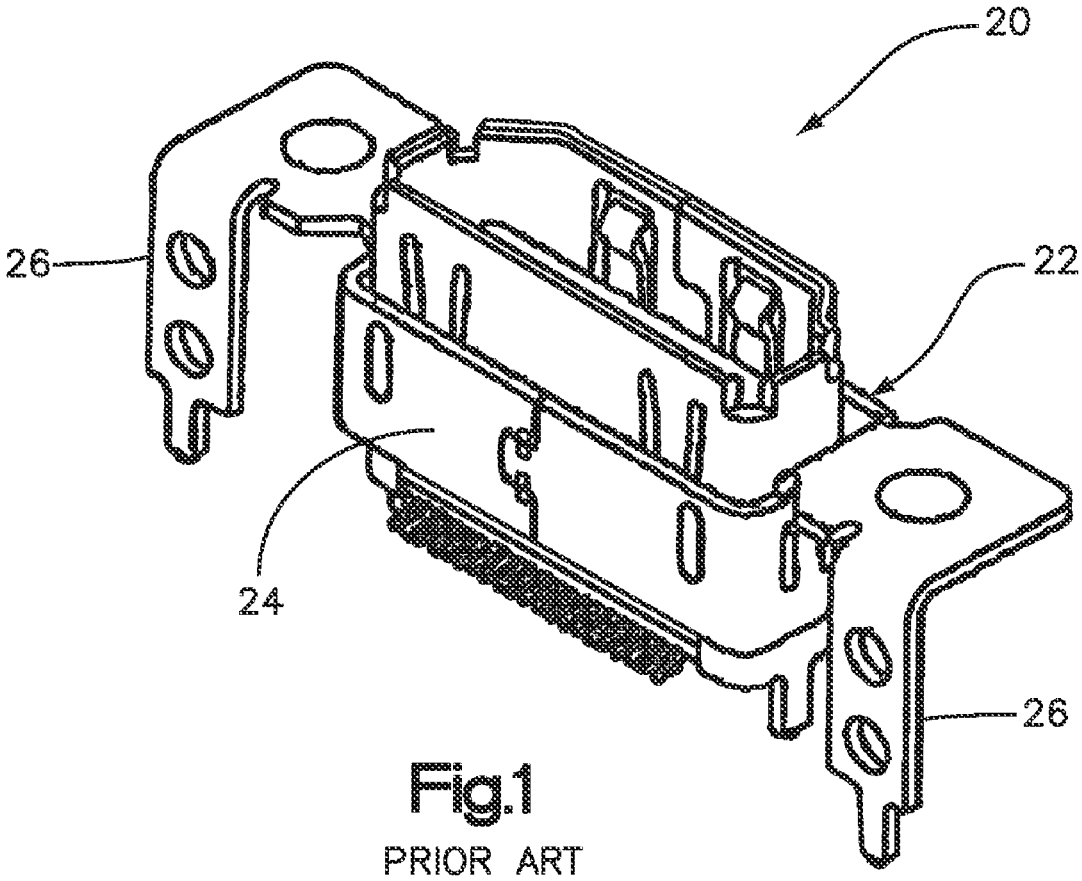
Fig.1 PRIOR ART
FIG. 1 is a perspective view of a conventional HDMI connector.
Figure 2:
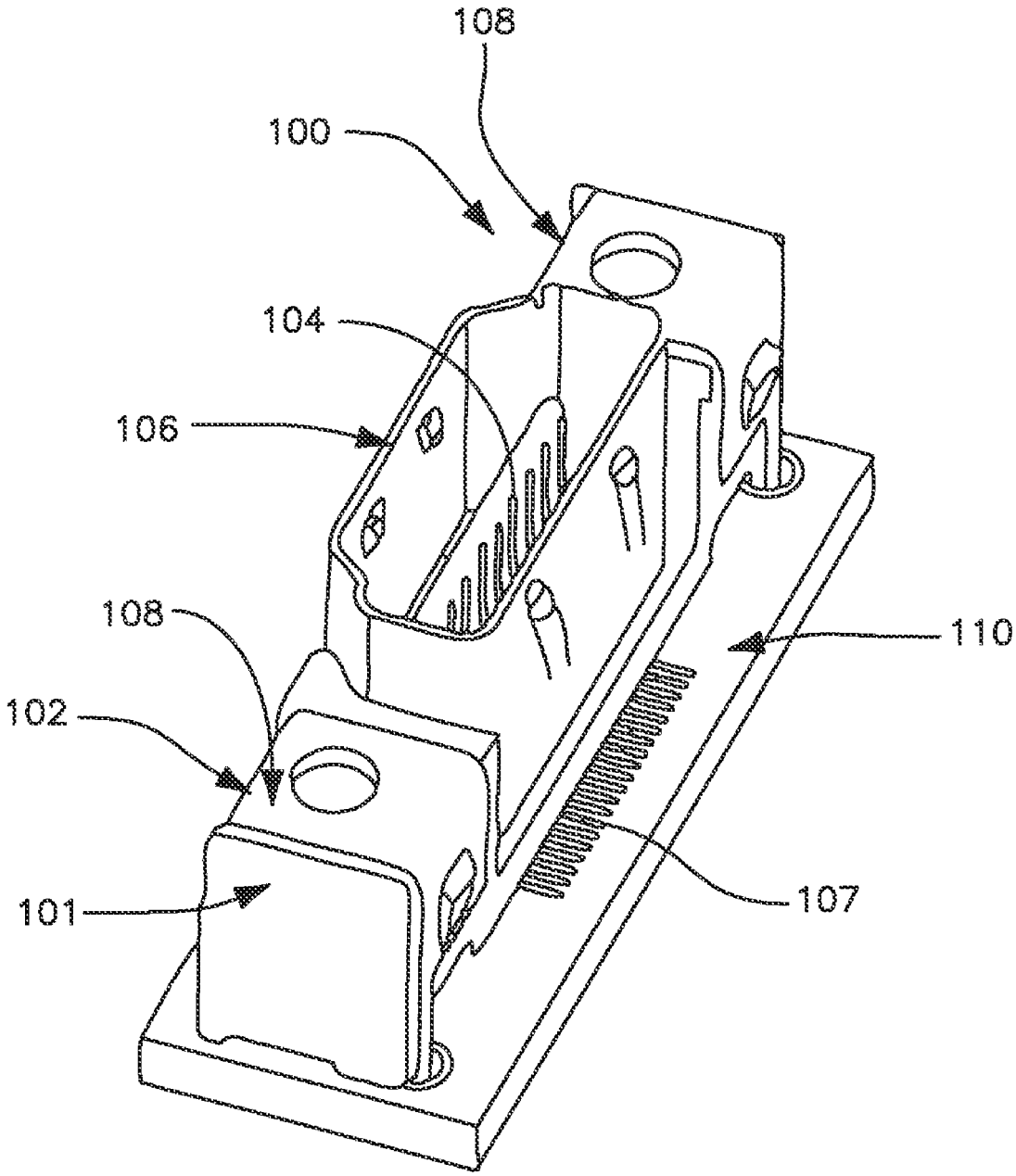
FIG. 2 is a front perspective view of a connector assembly constructed in accordance with one embodiment of the present invention connected to a printed circuit board.

Referring to FIG. 2, a connector assembly 100 is illustrated as a high definition multimedia interface (HDMI) connector assembly configured for attachment to an electrical component, such as a printed circuit board (PCB) 110. Connector assembly 100 includes an HDMI connector 101 having a connector housing 102 that retains a plurality of electrically conductive contacts 104, an HDMI protective shell 106, and a pair of support mounts 108. Electrical contacts 104 are connected to electrical traces 107 on PCB 110 when connector assembly 100 is mounted onto PCB 110. When mounted to PCB 110, shell 106 surrounds and protects the upper ends of electrical contacts 104 from becoming damaged. Support mounts 108 are configured to engage housing 102 and attach to PCB 110 to provide support and stabilization for connector 101. Connector assembly 100 will now be discussed in further detail with reference to FIGS. 3-6.

Figure 3:
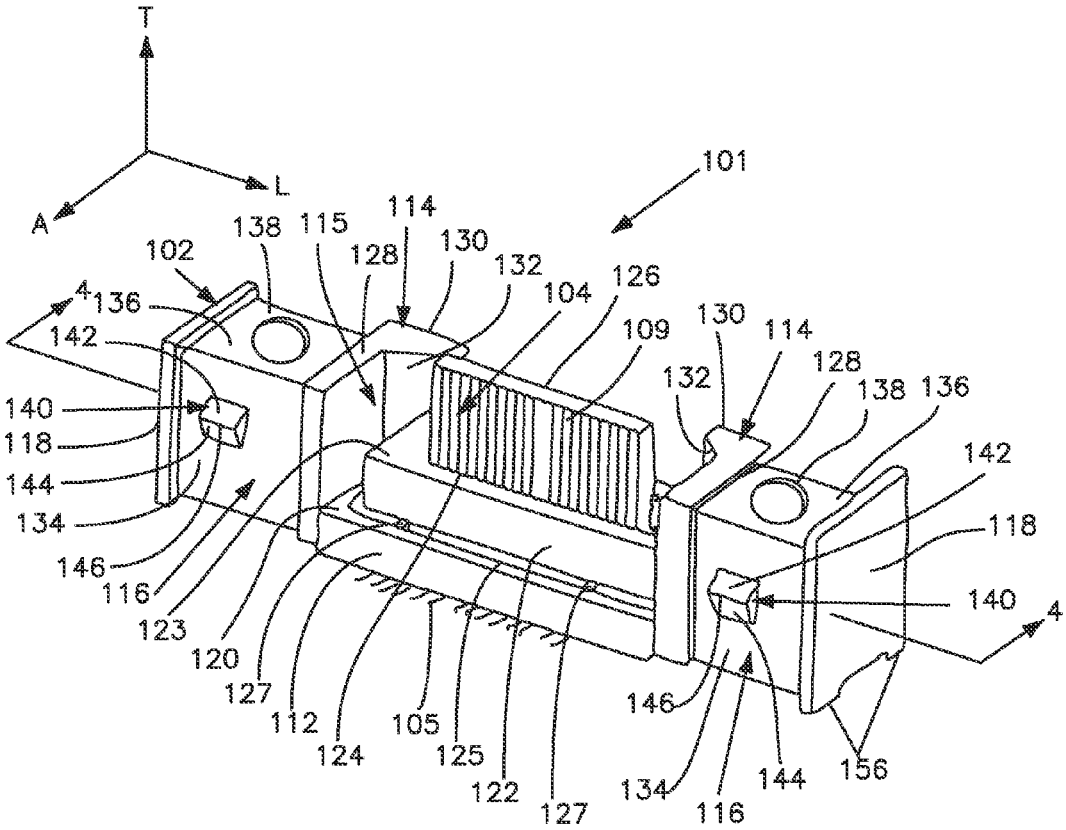
FIG. 3 is a perspective view of an HDMI connector that forms part of the connector assembly illustrated in FIG. 2.

Referring to FIG. 3 in particular, housing 102 is illustrated as being generally rectangular in shape, and can extend horizontally along a longitudinal direction "L" and lateral direction "A", and can extend vertically along a transverse direction "T". Housing 102 is elongate in the longitudinal direction L. Unless otherwise specified herein, the terms "lateral," "longitudinal," and "transverse" as used to describe the orthogonal directional components of connector 101 are likewise used to describe the directional components of the remainder of connector assembly 100 and PCB 110.

Housing 102 includes a longitudinally centrally disposed base 112, and a pair of dividers 114 disposed at opposing longitudinal outer ends of base 112 that define the longitudinally outer ends of an interior contact chamber 115. Housing 102 can further include a mounting support, such as a mounting block 116 that can be disposed adjacent to each divider 114, and a pair of vertical side walls 118 that can be disposed adjacent to each mounting block 116. Any or all components of connector housing 102 components can be integrally molded or otherwise integrally connected, or can alternatively be connected using glue, screws, or any known mechanical fastener.

HDMI connector 101 can further include a plurality of electrical contacts retained by housing 102. Specifically, base 112 can define a horizontal upper support surface 120 that is substantially flat. A retention channel 125 projects down through support surface 120 and into base 112, and as illustrated does not extend through base 112. Instead, retention channel 125 terminates at a location above the bottom surface of base 112. Retention channel 125 extends along the perimeter of base 112, and is configured to receive a portion of shell 106. Base 112 can include one or more (two as illustrated) locating ribs 127 that are disposed in retention channel 125 to assist in the proper positioning of shell 106 when connecting shell 106 to housing 102.

Base 112 can further support a contact casing 122 that extends upwards from support surface 120. Contact casing 122 can define a longitudinally elongate rectangular structure that defines an upper horizontal surface 123, and a longitudinally elongate rectangular opening 124 extending vertically into upper surface 123. Opening 124 provides a contact receptacle that supports electrical contacts 104. Specifically, a contact support housing 126 carries a plurality of electrical contacts 104, and extends vertically into opening 124. Connector 101 can also include a plurality of insert molded lead frame assemblies (IMLAs), not shown, that can mechanically secure electrically conductive contacts in the housing, as appreciated by one having ordinary skill in the art.

Electrical contacts 104 extend down from support housing 126, through base 112 and below retention channel 125, and can terminate at first terminal ends 105 that protrude out from the bottom edge of base 112. First terminal ends 105 of contacts 104 protrude laterally out from housing 102 and are configured to mechanically contact corresponding electrical traces 107 on PCB 110, thereby establishing an electrical connection between electrical contacts 104 and electrical traces 107. Specifically, first terminal ends 105 can be soldered to traces 107, or otherwise coupled to the traces 107 in any known manner appreciated by one having ordinary skill in the art. Electrical contacts 104 define a second terminal end 109 disposed opposite first terminal end 105. Second terminal ends 109 can extend up from housing 102, and can thus be exposed to the ambient environment for connection to, for instance, a counterpart HDMI plug connector (not shown).

Contact casing 122 is positioned and oriented on base 112 at a location such that retention channel 125 surrounds casing 122. Accordingly, when shell 106 is mounted onto housing 102, shell 106 surrounds and protects electrical contacts 104.

Figure 4:
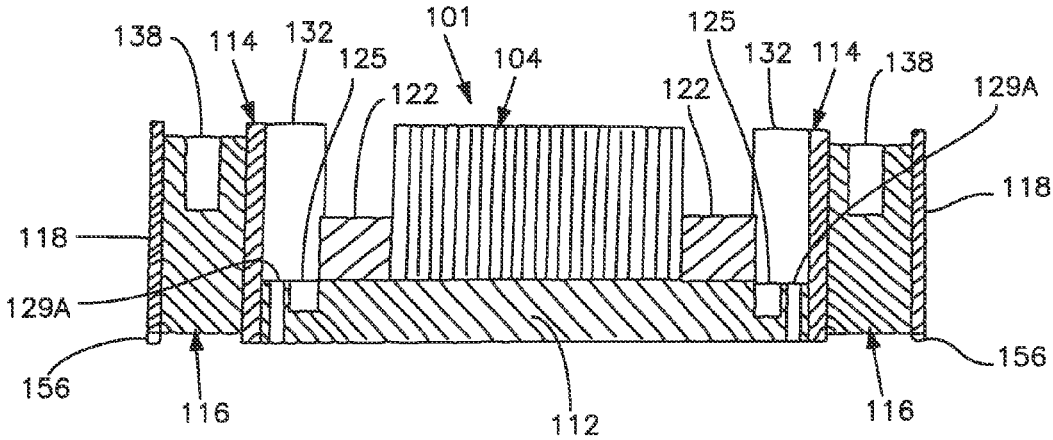
FIG. 4 is a sectional side elevation view of the HDMI connector taken along line 4-4 of FIG. 3.
Figure 7:
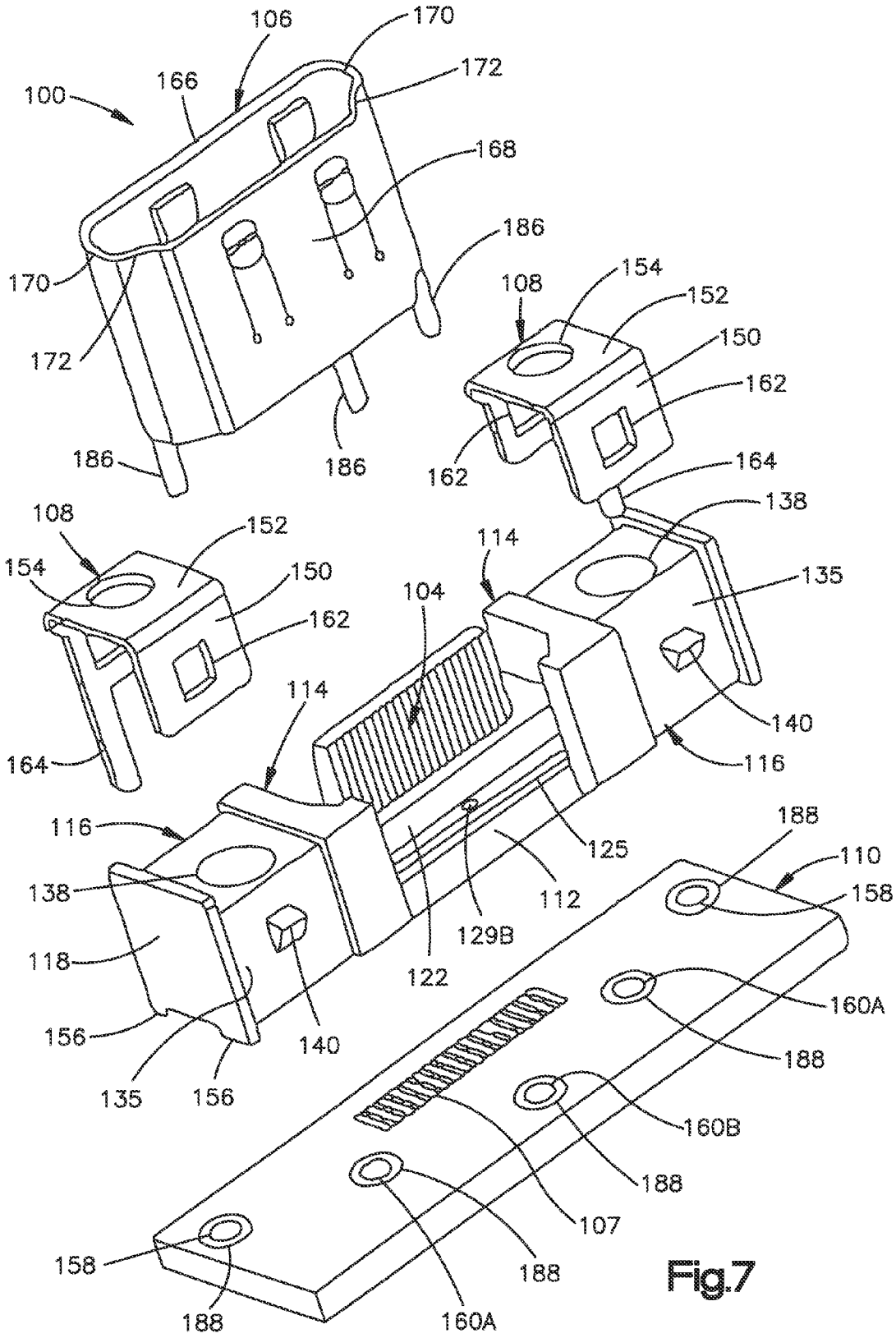
FIG. 7 is an exploded rear perspective view of the connector assembly illustrated in FIG. 2.

As illustrated in FIGS. 4 and 7, housing 102 further includes a plurality of apertures 129A-B that extend vertically through base 112. Specifically, a pair of apertures 129A can be disposed substantially midway between front and rear walls of base 112, and longitudinally outboard of retention channel 125, between retention channel 125 and divider114. Aperture 129B can be disposed substantially midway between dividers 114, and laterally outboard of retention channel 125, between retention channel 125 and the rear wall of base 112. Apertures 129A-B can be in alignment with apertures 160A-B, respectively, and extend into PCB 110. It should be appreciated that apertures 129A-B can extend through base 112 at any desired location that facilitates the attachment of shell 106 to housing 102, and subsequently to PCB 110.

Each divider 114 separates each longitudinal end of contact chamber 115 from a corresponding mounting block 116, and includes a vertical divider wall 128 extending upward from base 112, and laterally between the front and rear of the housing 102. A guide flange 130 extends longitudinally inward from one lateral end of each divider wall 128 that defines the rear of housing 102. Guide flange 130 is joined to divider wall 128 by an angled inner vertical guide wall 132. Guide wall 132 joins the longitudinally inner surface of each divider wall 128 and the laterally inner surface of the corresponding guide flange 130. Guide wall 132 is angled with respect to the longitudinal and lateral directions to mate with an outer surface of shell 106, thereby facilitating the attachment and retention of shell 106.

Each mounting block 116 can be substantially rectangular in shape, and can have a longitudinally extending front surface 134 and opposing rear surface 135 connected at their upper ends to an upper wall 136. Each mounting block 116 can have a height less than that of the adjacent divider 114 and side wall 118, such that the upper wall 136 is recessed with respect to the adjacent upper surfaces. Likewise, the opposing front and end wall surfaces 134 and 135, respectively, are laterally recessed with respect to the laterally opposing surfaces of the adjacent side wall 118 and divider 114. An opening 138 can extend vertically into upper wall 136 to define a screw hole configured to facilitate attachment of support mounts 108 to the housing 102.

Each mounting block 116 can further include an engagement member 140 operable to engage and retain a corresponding stand-alone support mount 108. Support mounts 108 can be called "stand-alone" support mounts because they can be individually mounted to, and removed from, housing 102. Specifically, each retention member 140 can be in the form of a retention ramp carried on front wall 134 and rear wall 135 (see FIG. 7) of each mounting block 116. Ramp 140 can include a downwardly sloped surface 142 protruding laterally outward from front surface 134, and an upwardly sloped surface 144 protruding laterally outward from front surface134. Upwardly sloped surface 144 is disposed beneath downwardly sloped surface 142 such that lower end of downwardly extending surface 142 and the upper end of upwardly extending surface 144 join to define a horizontal apex 146.

Each vertical side wall 118 can be connected to the longitudinally outer end of each corresponding mounting block 116. Side wall 118 can have a height greater than that of mounting block 116, and substantially equal to the height of corresponding divider 114. As a result, front and rear surfaces 134 and 135 and upper wall 136 of each mounting block 116 define a recess between corresponding side wall 118 and divider 114. Each side wall 118 can define a pair of laterally spaced and laterally elongate feet 156 extending down from the laterally opposing ends of the bottom edge of wall 118. Each foot 156 is configured to rest on the upper surface of PCB 110 when housing 102 is mounted onto PCB 110.

Figure 5:
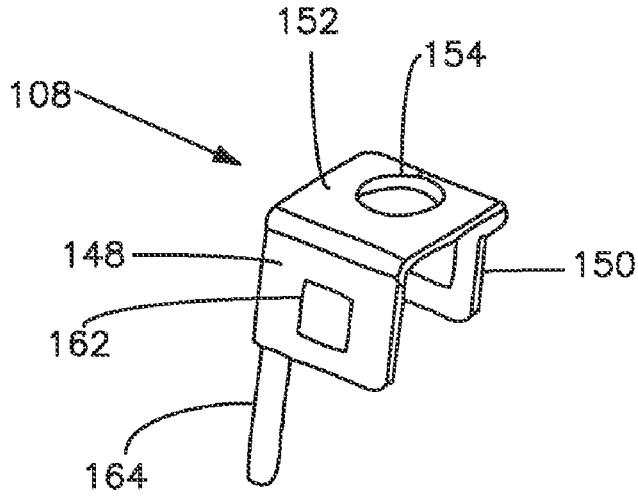
FIG. 5 is a perspective view of a support mount that forms part of the connector assembly illustrated in FIG. 2.

Referring now to FIG. 5, each support mount 108 can be substantially U-shaped, and configured to mount onto a corresponding one of mounting blocks 116, and can also attach to PCB 110 to provide support and stabilization for the HDMI connector. Specifically, each support mount 108 can include a vertical front wall 148 and an opposing rear wall 150 that are joined at their upper ends by a horizontal upper wall 152. Each support mount 108 is configured to attach to, or mount on, a corresponding mounting block 116 such that the front, rear, and upper walls of support mount 108 rest against the corresponding front, rear, and upper walls of the mounting block 116. Each support mount wall 148, 150 and 152 can have a thickness substantially equal to the depth of the recess between mounting block 116 and corresponding side wall 118 and divider 114. Accordingly, support mounts 108 can be substantially flush with side walls 118 and divider 114 when support mounts 108 are mounted to mounting blocks 116.

Each support mount 108 can further include ramp receiving apertures 162 that extend through front and rear walls 148 and 150, respectively. Apertures 162 can have a height slightly greater than the height of ramps 140, and a width slightly greater than the width of ramps 140 such that ramps 140 can fit within a corresponding aperture 162. Opposing walls 148 and 150 are separated by a distance slightly greater than the thickness of mounting blocks 116. The width of support mount walls 148, 150 and 152 is slightly less than the width of mounting blocks 116. Accordingly, each support mount 108 can fit over a corresponding mounting block 116. Front and rear support mount walls 148 and 150 can flex about upper wall 152, and/or can themselves be flexible.

Accordingly each support mount 108 is mounted onto its corresponding mounting block 116 such that the bottom edges of walls 148 and 150 can cam along upper surface 142 of ramp 140. The lower ends of walls 148 and 150 then ride along apex 146 until the edges of walls 148 and 105 that define the bottom edge of the apertures 162 cam over lower surface 144 of ramp 140. The interaction of walls 148 and 150 against ramp 140 causes walls 148 and 150 to snap down onto front and rear surfaces 134 and 135 of mounting block 116, thereby causing each ramp 140 to be disposed in a corresponding ramp-receiving aperture 162. The interference between ramps 140 and surfaces 134 and 135 that define apertures 162 mechanically attaches support mounts 108 to housing 102.

Support mounts 108 can be further affixed to mounting blocks 116 via apertures 154 that can extend vertically through upper wall 152 to provide a screw hole that can be laterally and longitudinally aligned with opening 138 extending into upper wall 136 of a corresponding mounting block 116. Any suitable fastener, such as a threaded fastener 155 (see FIG. 8) can be received by aperture 154 and opening 138 to fasten each support mount 108 to a corresponding mounting block 116. Thus, in addition to the engagement between support mounts 108 and retention ramps 140 on mounting blocks 116, a screw or like fastener can be used to further attach support mount 108 to mounting block 116.

Each support mount 108 can further include at least one support mount attachment member in the form of an extension 164 that facilitates attachment of support mounts 108 to PCB 110. As illustrated, a plurality of extensions 164 can be provided as legs that extend vertically downward from longitudinally outer end of front wall 148. Each extension 164 can extend into or through a corresponding aperture 158 extending through PCB 110 to attach support mount 108, and therefore connector assembly 100, to PCB 110. It should be appreciated that one or more extensions 164 can be connected to support mounts 108, and that extensions 164 can extend from any desired location on support mounts 108 to facilitate attachment to PCB 110. Extensions 164 can be cylindrical as illustrated, or can assume virtually any shape sufficient to attach to circuit board 110. Support mounts 108 can be made of a conductive material, and therefore can also perform a grounding function or provide for electro-static discharge when connector assembly 100 is mounted onto PCB 110.

It should be appreciated by one having ordinary skill in the art that extensions 164 are just one example of attachment members that facilitate a connection between support mounts 108 and PCB 110, and that any suitable structure that is configured to connect support mounts 108 to PCB 110, including structures that connects support mounts 108 to connector 101, and that in turn connects connector 101 PCB 110, is contemplated by the present invention.

Figure 6:
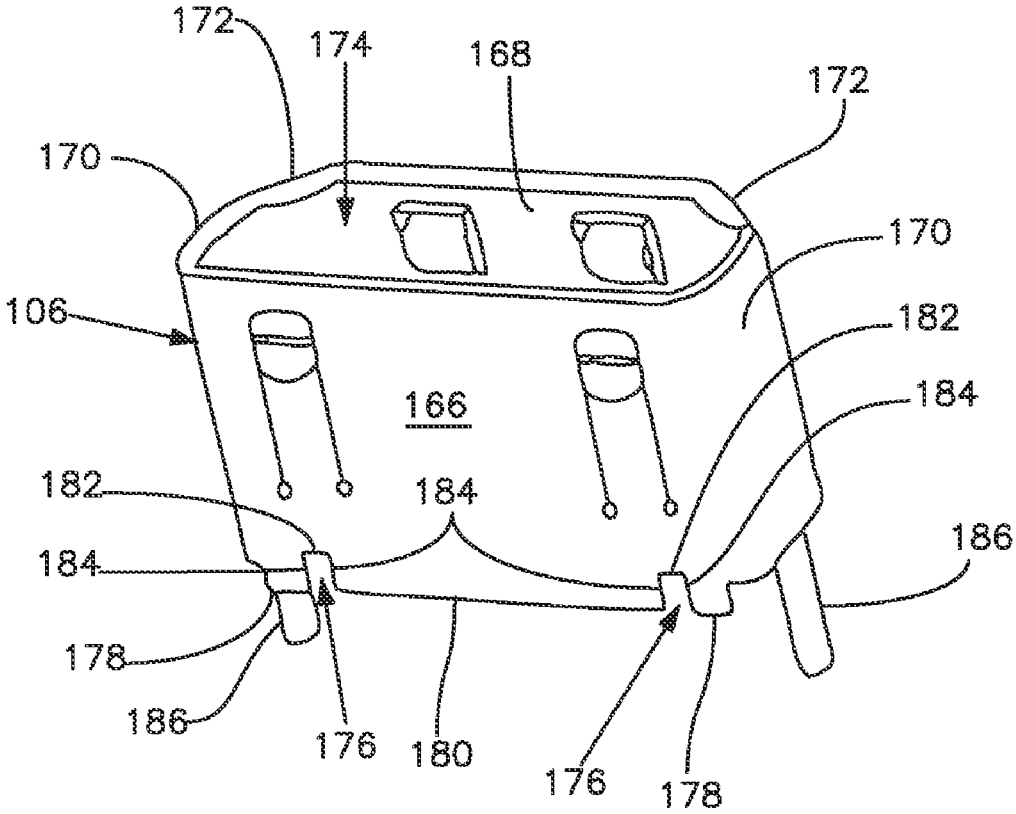
FIG. 6 is a perspective view of an HDMI protective shell that can form part of the connector assembly illustrated in FIG. 2.

Referring to FIG. 6, shell 106 is vertically oriented, and includes a body having a front wall 166 and a rear wall 168 spaced from front wall 166. Walls 166 and 168 are joined at their longitudinally opposing ends by side walls 170. At least one of side walls 170, and both side walls 170 as illustrated, is joined to rear wall 168 by a transition portion 172 that can define an angle with respect to adjacent side wall 170 and rear wall 168. The curvature profile of the outer surfaces of side walls 170, transition portion 172, and rear wall 168 substantially matches the curvature profile of the inner surfaces of dividers 114 such that the dividers 114 provide a guide when inserting shell 106 into contact chamber 115. Shell 106 is open at its upper and lower ends, and defines a vertically extending void 174 that provides a protection chamber that is sized and positioned to receive electrical contacts 104 of connector 101. Front wall 166, rear wall 168, side walls 170, and transition portions 172 have a thickness not greater than, the thickness of retention channel 125, such that shell 106 can extend into the channel 125 when shell 106 is mounted onto the connector housing 102.

Additionally, the lower end of shell 106 is configured to facilitate reliable insertion and retention of shell 106 into retention channel 125 of connector housing 102. Specifically, shell 106 can include a pair of locating recesses 176 that are configured to receive corresponding locating ribs 127 disposed in retention channel 125. The lower end of front wall 166 includes a pair of downwardly projecting tabs 178 disposed at longitudinally outer ends of front wall 166. A middle projection 180 likewise projects downwards and is disposed between tabs 178, and spaced from tab 178 such that recesses 176 are disposed between tabs 178 and middle projection 180. Each recess 176 can thus be defined by an upper recess edge 182, and opposing side recess edges 184.

Shell 106 can further include at least one shell attachment members in the form a leg 186 that is configured to connect shell 106 to PCB 110. As illustrated, one leg 186 can extend vertically downward from each side wall 170, and another leg 186 can likewise extend down from rear wall 168. Legs 186 extending from side walls 170 project down a sufficient distance to extend through apertures 129A, and the leg 186 extending down from rear wall 168 projects down a sufficient distance to extend through aperture 129B (see FIGS. 4 and 7). Legs 186 can be received by apertures 160A-B of PCB 110 (see FIG. 8). Locating ribs 127 provide a key to ensure that legs 186 are aligned with the respective apertures 160A-B on PCB 110 when shell 106 is mounted onto connector housing 102. Legs 186 can be cylindrical as illustrated, or can assume virtually any shape sufficient to attach to PCB 110 as described in more detail below.

It should be appreciated by one having ordinary skill in the art that legs 186 are just one example of attachment members that facilitate a connection between shell 106 and PCB 110, and that any suitable structure that is configured to connect shell 106 to PCB 110, including structures that connects shell 106 to connector 101, and that in turn connects connector 101 to PCB 110, is contemplated by the present invention.

The installation of the connector assembly 100 along with the connection of connector assembly 100 to PCB 110 will now be described with reference to FIG. 8. It should be appreciated that unless otherwise specified, the steps described below need not be performed in the order described.

First, each support mount 108 can be attached to a corresponding mounting block 116 by aligning screw aperture 154 of support mount 108 with opening 138 of mounting block 116. Next, support mount 108 is mounted onto mounting block 116 by sliding front and rear walls 148 and 150 of support mount 108 along front and rear surfaces 134 and 135 of mounting block 116. As support mount 108 slides onto mounting block 116, walls 148 and 150 cam over retention ramp 140 in the manner described above with reference to FIG. 5. Fastener 155 can then be inserted into apertures 154 and openings 138 to further affix support mounts 108 to mounting blocks 116. Once support mounts 108 are mounted onto mounting blocks 116, support mount extensions 164 are disposed adjacent a corresponding side wall 118, and extend below feet 156 of side wall 118. Each support mount 108 can engage connector housing 102 at more than one surface, and three surfaces as illustrated (e.g., front wall 148, rear wall 150, and upper wall 152). The multiple engagement surfaces, along with retention ramp 140 and fastener 155, provide more support to support mount 108 than achieved in conventional connector support structures. It should be further appreciated that support mounts 108 can be removed from housing 102 by removing fastener 155 from apertures 154 and openings 138, and sliding front and rear walls 148 and 150 upwards over ramps 140.

Shell 106 can be attached to connector housing 102 by aligning locating recesses 176 with locating ribs 127 in retention channel 125. Next, because tabs 178 and middle portion 180 extend below side walls 170, rear wall 168, and transition portions 172 of shell 106, tabs 178 and middle projection 180 of shell 106 are first inserted into channel 125. As shell 106 is further depressed, the lower ends of rear wall 168, side walls 170, and transition portions 172 are inserted into retention channel 125. Shell 106 can be fully inserted once edges 182 that defines the upper end of recesses 176 abut locating ribs 127. Alternatively, retention channel 125 can extend along the front end of base 112 such that tabs 178 and middle portion 180 extend into channel 125 while the lower ends of rear wall 168, side walls 170, and transition portions 172 rest against base 112.

As illustrated, upper recess edge 182 can be disposed above the lower ends of rear wall 168, side walls 170, and transition portions 172. Accordingly, when upper recess edge 182 abuts corresponding locating rib 127, the lower edges of rear wall 168, side walls 170, and transition portions 172 can extend into retention channel 125 when shell 106 is mounted onto housing 102. Alternatively, or additionally, the upper ends of locating ribs 127 can terminate within retention channel 125, or below upper surface 120 of housing base 112, to ensure that the lower edges of rear wall 168 and side walls 170 extend into retention channel 125 when shell 106 is mounted onto connector housing 102.

As shell 106 is mounted onto connector housing 102, electrical contacts 104 extend into void 174 such that the upper end of shell 106 is disposed above the upper end of electrical contacts 104, and above the upper end of contact support housing 126 when shell 106 is fully inserted into retention channel 125. Contacts 104 are thus surrounded, and protected, by shell 106. Legs 186 of shell 106 extend through apertures 129 extending through base 112 of housing 102 and terminate at a location below feet 156 of side walls 118.

Once protective shell 106 is mounted onto housing 102 and PCB 110, shell 106 surrounds and protects electrical contacts 104. However, Shell 106 need not be a continuous structure that surrounds the entirety of electrical contacts 104. For instance, shell 106 could include apertures, or disconnects. Accordingly, it can be said that shell 106 surrounds at least a portion of, or a substantial entirety of, electrical contacts 104, and in particular second terminal ends 109 of electrical contacts 104.

Figure 8:
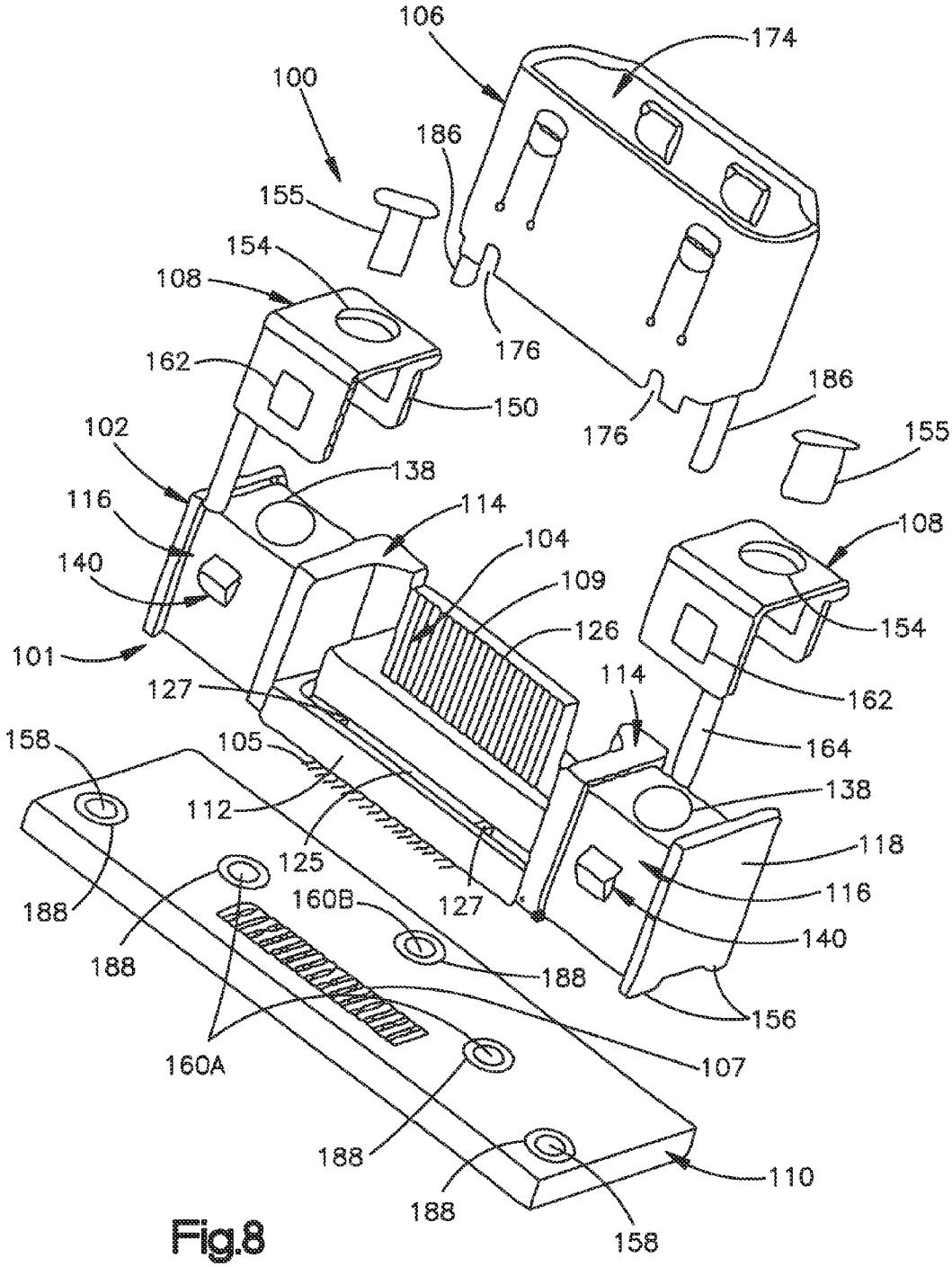
FIG. 8 is an exploded assembly view of the connector assembly illustrated in FIG. 2 being connected to a printed circuit board.

With continuing reference to FIG. 8, PCB 110 is illustrated as a longitudinally elongate body extending along a horizontal plane. Electrical traces 107 are disposed on the upper surface of PCB 110 and are spaced longitudinally so as to be in alignment with terminal ends 105 of connector 101. A plurality of mounting apertures 158, 160 extend vertically into PCB 110 configured to receive support mount extensions 164 and protective shell legs 186. Mounting apertures 158, 160 can extend into or through PCB 110 depending on the length of the structures that are configured to fit into or through the apertures and nature of the engagement between the structures and the apertures when the connector assembly 100 is mounted onto PCB 110.

Specifically, a pair of forward apertures 158 can extend into or through PCB 110, and are positioned at longitudinally opposite ends of PCB 110 so as to engage support mounts 108. A plurality of rear mounting apertures 160A-B can be positioned rearward of forward mounting apertures 158 so as to engage shell 106. Apertures 160A are longitudinally spaced and located longitudinally inboard, and behind, apertures 158. Aperture 160B is disposed behind apertures 160A, and located between apertures 160A with respect to the longitudinal direction. It should be appreciated that a greater or fewer number of mounting apertures could be present on PCB 110, depending on the number of legs on connector assembly 100 that are desired to satisfactorily engage the corresponding mounting apertures carried by PCB 110. Apertures 158-160 can each be coated with a conductive material 188, if desired.

As illustrated, legs 186 of shell 106 and support mount extensions 164 terminate at a location below feet 156 of side walls 118. Accordingly, when housing 102 is placed onto PCB 110 such that feet 156 and the lower end of base 112 rest on PCB 110, support mount extensions 164 can extend into apertures 158, and legs 186 extend into apertures 160A-B. The diameter of legs 186 and support mount extensions 164 can be sized such that an interference fit is created between the extensions and apertures 158, 160. In the alternative, legs 186 and extensions 164 can be surface mounted to PCB 170. Furthermore, either or all of mounts 108 and shell 106 can be made of a conductive material, and therefore may also perform a grounding function or provide for electro-static discharge when connector assembly 100 is mounted to PCB 110.

It should be appreciated that while FIGS. 2-8 illustrate one embodiment of the present invention, the present invention contemplates alternative embodiments that support the connection of an HDMI connector to a PCB. For example, it should be appreciated that the shell 106 and support mounts 108 can engage connector housing 102 in any desired manner such that shell 106 and support mounts 108 support connector 101 when attached to PCB 110. Furthermore, mounting blocks 116 can be sized and shaped in any known manner sufficient to engage support mounts 108 in order to assist in securing connector 101 to PCB 110. Likewise, support mounts 108 can be configured in any known manner sufficient to engage housing 102 and attach to PCB 110. Shell 106 could likewise assume any desired size and shape capable of protecting electrical contacts 104. As illustrated, protective shell 106 is secured to PCB. It should be appreciated, however, that protective shell 106 could alternatively connect directly to housing 102.

Connector assembly 100 can also include one or more additional components, such as a dust guard. One such alternative embodiment is illustrated in FIG. 9.

Figure 9:
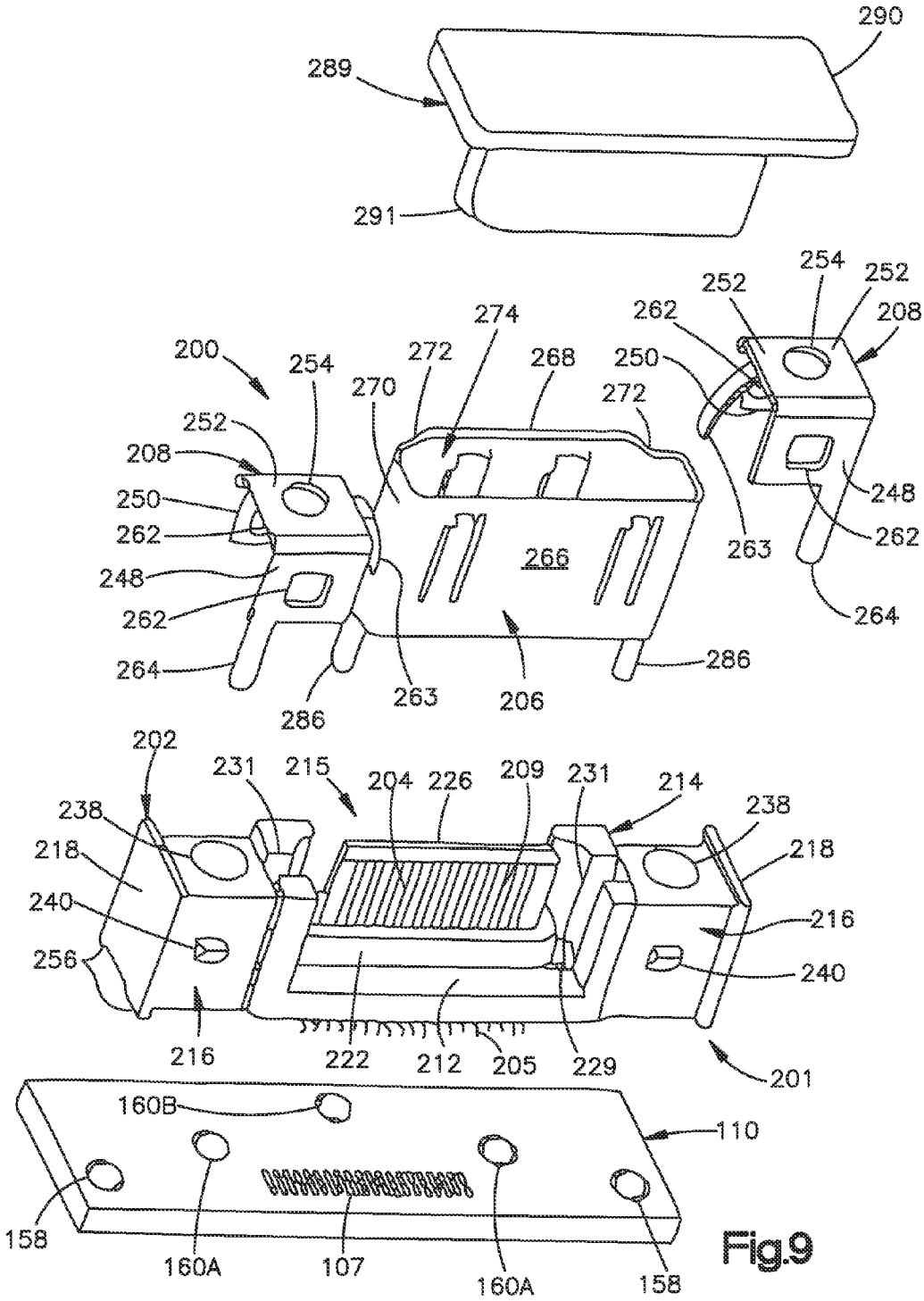
FIG. 9 is an exploded view of an HDMI connector assembly constructed in accordance with an alternative embodiment connected to a printed circuit board.

Referring now to FIG. 9, one alternative embodiment showing a connector assembly 200 is illustrated having reference numerals of elements corresponding to like elements of FIGS. 2-8 incremented by 100 for the purposes of clarity and convenience. The connector assembly 200 includes an HDMI connector 201 having a connector housing 202, an HDMI protective shell 206, and a pair of support mounts 208. Connector assembly 200 can further include a protective dust cover 289 that can aid in preventing dust, debris, and the like from entering into shell 206 and compromising the electrical contacts 204. Certain differences between Connector assembly 200 and Connector assembly 100 that depict exemplary alternative embodiments will now be described.

The lower end of shell 206 extends horizontally, and does not include the recesses similar to recesses 176 of shell 106. Furthermore, base 212 of connector housing 202 does not include a retention channel, but rather supports a retainer casing 222 that extends vertically upwards from base 212. Retainer casing 222 has an outer periphery that can correspond to the inner periphery of shell 206. Accordingly, shell 206 can circumscribe retainer casing 222 while the lower end of front wall 266, rear wall 268, side walls 270, and transition portions 272 abut base 212. If desired, retainer casing 222 can be sized slightly less than shell 206 such that a pressure fit is achieved when shell 206 engages housing 202. Legs 286 of shell 206 can extend through apertures 229 of housing 202 in the manner described above.

Support mounts 208 can be constructed similar to support mounts 108 described above, but can further include a conductive engagement tab 263 that projects longitudinally out and down from the longitudinally inner edge of upper wall 252 of support mount 208 toward adjacent side wall 270 of shell 206. Engagement tab 263 can be flexible, and can have a spring force that causes engagement tab 263 to engage side wall 270 of shell 206. Engagement member 263 can further be made from conductive material such that the support mount 208 becomes grounded to the shell 206, thereby improving the electro-magnetic interference characteristics.

Housing 202 can include a base 212 that supports a retainer casing 222, a pair of dividers 214 disposed longitudinally outboard of base 212, a mounting support 216 in the form of a mounting block disposed longitudinally outboard of each divider 214, and a side wall 218 disposed longitudinally outboard of mounting blocks 216. Divider 214 defines a vertical channel 231 extending into vertical divider wall 218. Channel 231 extends downward from the upper end of vertical wall 218 towards base 212, and has a rectangular profile having a lateral thickness sized to receive engagement tab 263. Channel 231 can terminate at base 212 or before base 212 so that that channel 231 is configured to receive engagement tab 263 when the connector assembly is mounted onto PCB 110.

Figure 10:
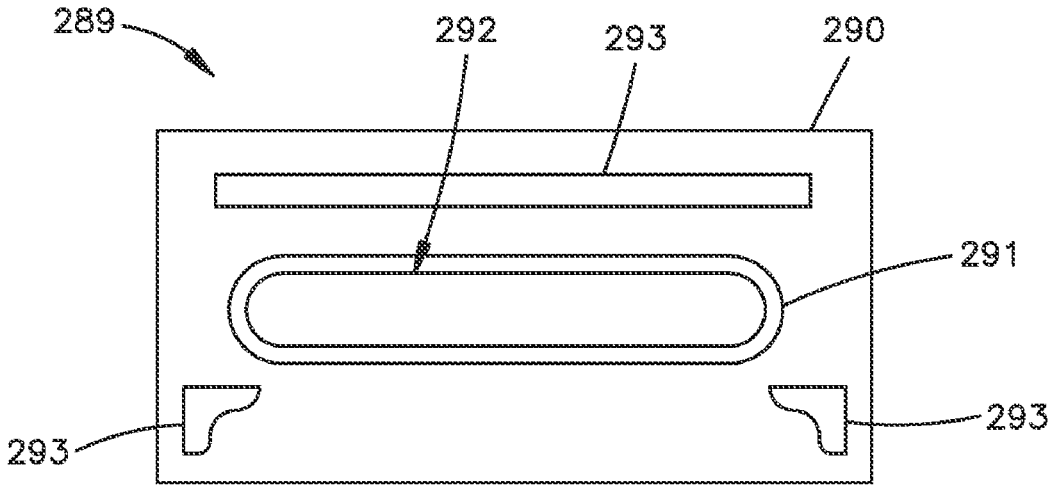
FIG. 10 is a bottom plan view of a dust cover forming part of the connector assembly illustrated in FIG. 9.

Referring also to FIG. 10, dust cover 289 can be formed from a dielectric material, and can engage shell 206 to assist in the prevention of dust and debris from entering contact chamber 215 where it could otherwise compromise electrical contacts 204. Cover 289 can include an upper plate 290 and an insert 291 projecting down from upper wall 290. Upper plate 290 can be in the shape of a longitudinally elongate rectangle, and extend along a horizontal plane. In particular, plate 290 can extend a longitudinal distance greater than the longitudinal distance of void 274 (or distance between opposing side walls 270), and can extend a lateral distance greater than the lateral distance of void 274 (or distance between the opposing front wall 266 and rear wall 268). Accordingly, upper plate 290 can abut the upper ends of front wall 266, rear wall 268, side walls 270, and transition portions 272 and cover void 274.

Insert 291 can extend a longitudinal distance less than the longitudinal distance of upper plate 290, and can extend a lateral distance less than the lateral distance of upper plate 290. Insert 291 defines a void 292 that extends vertically into the insert and can terminate at or before upper plate 290 such that the height of the void is sized to receive contact support housing 226 and electrical contacts 204. The lower end of insert 291 can abut the upper surface of retainer casing 222, or can terminate above the upper surface of retainer casing 222 when upper plate 290 abuts the upper end of shell 206.

Void 292 extends a longitudinal distance that is less than the longitudinal distance of void 274 (or distance between opposing side walls 270), and greater than the longitudinal distance of contact support housing 226. Void 292 extends a lateral distance that is less than the lateral distance of void 274 (or distance between the opposing front wall 266 and rear wall 268), and greater than the lateral distance between the laterally opposing edges of retainer casing 222 or contacts 204. Accordingly, void 292 is sized to provide a receptacle that receives casing 222 and contacts 204 when cover 289 is mounted onto protective shell 206.

Cover 289 can further include a plurality of keys 293 that properly locate cover 289 on shell 206. Keys 293 extend down from the lower surface of plate 290 and define shell-engaging surfaces 294 that are positioned and contoured to couple to the upper end of the inner surface of shell 206 when upper cover 290 is placed onto shell 206 in the proper position and orientation. Surfaces 294 are positioned and contoured to interfere with the inner surface of shell 206 when cover 290 is placed onto shell 206 in an improper position or orientation. When cover 289 is properly oriented on shell 206, receptacle 292 is aligned with contact support housing 226 and contacts 204.

Connector assembly 200 can be mounted onto PCB 110 by inserting legs 286 of protective shell 206 through apertures 229 of housing 202, thereby causing the lower end of shell 206 to surround retainer casing 222, and thus contact receptacle 224 and contacts 204. Once the shell 206 is attached to housing 202, support mounts 208 are attached to a corresponding mounting block 216 by sliding front and rear walls 248 and 250 of support mount 208 along mounting block 216 so that walls 248 and 250 cam over retention ramp 240. A fastener (not shown in FIG. 9) can then be inserted into screw holes 254 and 238 to further affix support mounts 208 to mounting blocks 216. As support mount 208 slides along mounting block 216, engagement tab 263 slides within channel 231 along the longitudinally outer edge of side wall 270. Once support mounts 208 are mounted onto mounting blocks 216, engagement tab 263 is biased against the outer edge of side wall 270 to establish an electrical connection between support mounts 208 and protective shell 206. Legs 286 of shell 206 and support mount extensions 264 are then inserted into PCB apertures 158, 160 in the manner described above.

Figure 11:
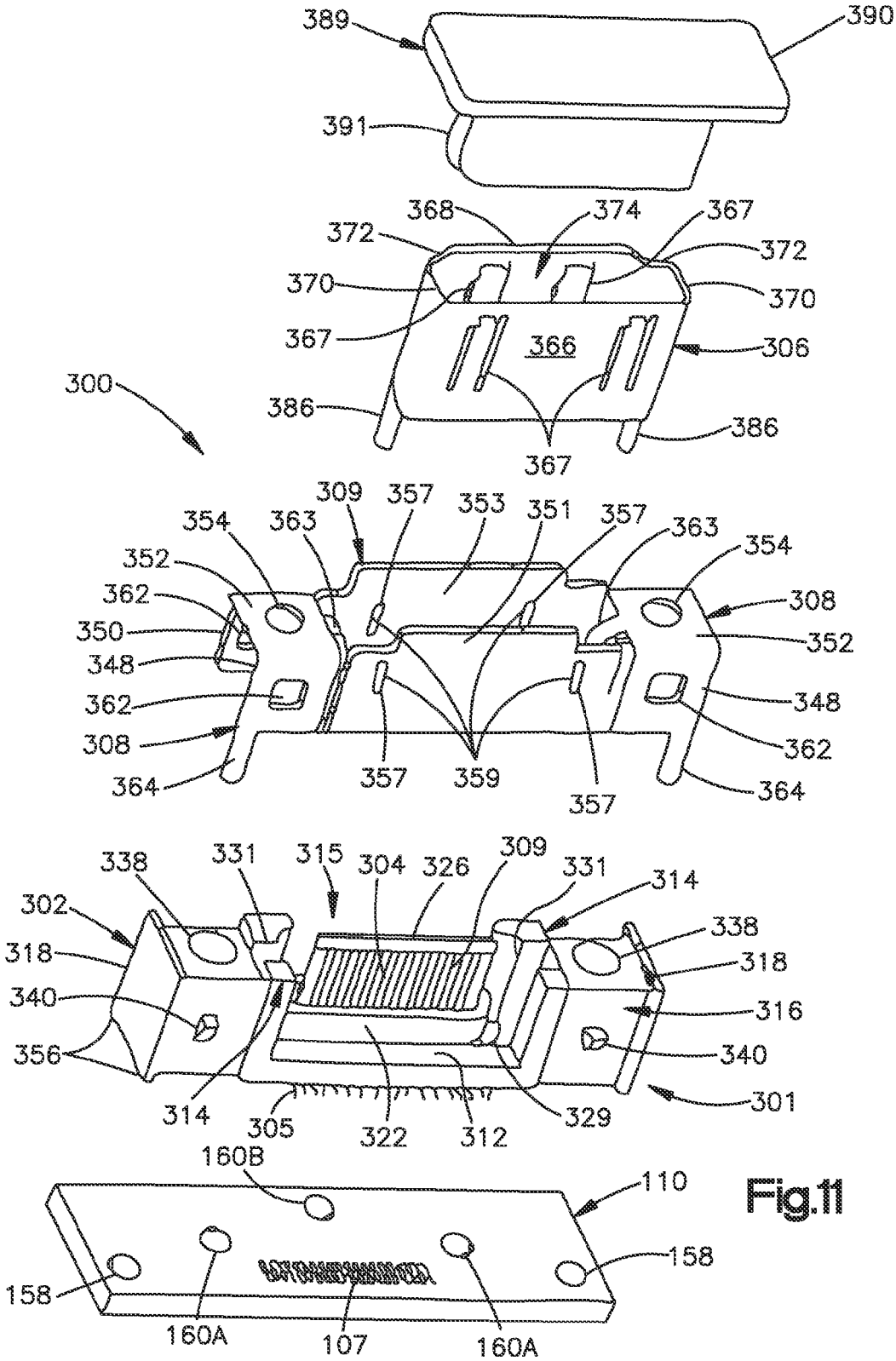
FIG. 11 is an exploded view of an HDMI connector assembly constructed in accordance with another alternative embodiment connected to a printed circuit board.

Referring now to FIG. 11, a connector assembly 300 is illustrated having reference numerals of elements corresponding to like elements of FIG. 9 incremented by 100 for the purposes of clarity and convenience. Connector assembly 300 includes an HDMI connector 301 having a connector housing 302, an HDMI protective shell 306, a pair of support mounts 308, and a dust cover 389.

Connector assembly 300 can further include support mount housing 309 that includes a pair of support mounts 308 connected by vertical front and rear contact walls 351 and 353, respectively. Contact walls 351 and 353 can connect to shell 306 to ground support mounts 308 to shell 306, which can improve the electro-magnetic interference characteristics.

In the present embodiment, support mounts 308 and contact walls 351, 353 are integrally formed of a single piece of metal plate, by stamping for instance. Contact walls 351 and 353 extend longitudinally between support mounts 308. Front contact wall 351 is connected at its longitudinally outer ends to front walls 348 of support mounts 308. Rear contact wall 353 is connected at its longitudinally outer ends to rear walls 350 of support mounts 308. Contact walls 351 and 353 are spaced a lateral distance apart that is slightly greater than the lateral width of dividers 314. Front contact wall 351 thus spans across the front end of housing 302 between mounting blocks 316, and rear contact wall 353 spans across the rear end of housing 302 between mounting blocks 316 when support mounts 308 are mounted onto mounting blocks 316. Shell 306 can thus be received between walls 351 and 353 when shell 306 is connected to housing 302 and mounted onto PCB 110. Walls 351 and 353 have a longitudinal length such that engagement members 363 of support mounts 308 contact the outer surfaces of side walls 370 when shell 306 is inserted between walls 351 and 353.

Contact walls 351 and 353 can further include protrusions 357 that are configured to contact the outer surfaces of respective front and rear walls 366 and 368 of shell 306. Each protrusion 357 has a contact surface 359. When shell 306 is inserted between walls 351 and 353, protrusions 357 is brought into contact with the inner surface of front or rear wall 366 and 368 at one or both longitudinally opposing ends. Front and rear surfaces 366 and 368 of shell 206 can include flexible tabs 367 that extend vertically and can be biased outward. Tabs 367 can be in alignment with protrusions 357 to ensure that tabs 367 will contact plates 357 when shell 306 is inserted between contact walls 351 and 353.

The invention claimed is:

1. An electrical connector assembly comprising:

a housing elongate between opposed first and second ends;

a plurality of electrical contacts extending through the housing along a first direction, each of the electrical contacts having a first terminal end extending out from the housing and configured to engage electrical traces of an electrical component, and an opposed second terminal end extending out from the housing;

a pair of support mounts that are detachably mountable onto the first and second ends of the housing, respectively, along mounting trajectories that are substantially parallel to the first direction, each of the support mounts including a front wall, a rear wall spaced from the front wall, and an upper wall joining upper ends of the front and rear walls, respectively, each of the support mounts configured to engage with respective engagement members carried by the housing, and each of the support mounts including at least one attachment member configured to attach to the electrical component when the first terminal ends of the electrical contacts are connected to the traces of the electrical component; and opposed front and rear contact walls, the front contact wall extending between the front walls of the support mounts, the rear contact wall extending between the rear walls of the support mounts.

2. The electrical connector assembly as recited in claim 1, wherein the housing defines a mounting support at each of the first and second ends, each of the mounting supports configured to engage at least two surfaces of a respective one of the support mounts, and wherein each mounting support carries at least one of the engagement members.

3. The electrical connector assembly as recited in claim 1, wherein the housing defines a mounting support at each of the first and second ends, and wherein the front, rear, and upper walls of each support mount are configured to engage corresponding front, rear, and upper walls of a respective one of the mounting supports.

4. The electrical connector assembly as recited in claim 3, wherein each engagement member includes a projection extending from at least one wall of a respective one of the mounting supports, and wherein a complementary wall of a corresponding one of the support mounts defines an aperture configured to receive the projection.

5. The electrical connector assembly as recited in claim 3, wherein a first aperture extends through at least one of the support mounts, and a second aperture extends into a corresponding one of the mounting supports such that the first and second apertures are aligned when the at least one of the support mounts is mounted onto the corresponding mounting support, and wherein the electrical connector assembly further comprises a fastener configured to extend through the first and second apertures to secure the at least one of the support mounts onto the corresponding mounting support.

6. The electrical connector assembly as recited in claim 1, further comprising a protective shell defining a body having a perimeter sized to surround at least a portion of the second terminal end of the electrical contacts, wherein the protective shell includes at least one shell attachment member configured to extend through the housing and be received in a complementary aperture disposed in the electrical component when the protective shell is mounted onto the housing.

7. The electrical connector assembly as recited in claim 6, wherein the support mounts and the protective shell are electrically conductive, and each support mount further includes a conductive engagement tab configured to contact the protective shell to ground the support mount to the protective shell.

8. The electrical connector assembly as recited in claim 6, further comprising a dust cover including an upper plate and an insert extending down from the upper plate, wherein the upper plate is configured to sit on top of the protective shell and the insert is disposed adjacent to the contacts when the upper plate is seated on the protective shell.

9. The electrical connector assembly as recited in claim 6, wherein each support mount further includes a conductive engagement tab configured to contact the protective shell, and wherein the front and rear contact walls each define at least one protrusion configured to contact the protective shell.

10. An electrical connector assembly comprising:

a housing including a pair of mounting supports;

a plurality of electrical contacts supported by the housing, the electrical contacts configured to be connected to electrical traces of an electrical component; and a support mount housing including a front contact wall, a rear contact wall, and a pair of support mounts configured to be vertically mounted onto respective ones of the mounting supports, each support mount including opposed front and rear support mount walls configured to engage corresponding front and rear mounting support walls of a respective one of the mounting supports, wherein the front contact wall connects the front support mount walls to one another and the rear contact wall connects the rear support mount walls to one another, and wherein each support mount further includes an extension configured to be received in a complementary aperture disposed in the electrical component when the electrical contacts are connected to the electrical traces of the electrical component.

11. The electrical connector assembly as recited in claim 10, wherein each mounting support carries at least one engagement member configured to be received by a respective one of the support mounts when the support mounts are mounted onto respective mounting supports.

12. The electrical connector assembly as recited in claim 10, wherein each mounting support carries a pair of projections, and wherein each support mount defines a pair of apertures configured to receive the projections of a corresponding mounting support.

13. The electrical connector assembly as recited in claim 12, wherein each pair of projections includes a first projection carried by the front mounting support wall of a corresponding mounting support and a second projection carried by the rear mounting support wall of the corresponding mounting support.

14. The electrical connector assembly as recited in claim 10, wherein each support mount further includes an upper wall joining respective upper ends of the front and rear support mount walls.

15. An electrical connector assembly comprising:

a High-Definition Multimedia Interface (HDMI) electrical connector including:

a housing including a pair of mounting supports and a base extending between the mounting supports, wherein each mounting support includes at least one engagement member; and a plurality of electrical contacts supported by the base and defining a first terminal end configured to connect to electrical traces of an electrical component, and a second terminal end disposed opposite the first terminal end, wherein the second terminal end extends beyond the housing;

a pair of support mounts, each support mount including a pair of spaced walls configured to receive one of the mounting supports therebetween, wherein each support mount is configured to mate with the engagement member and includes an extension configured to be received in a complementary aperture extending into the electrical component; and a protective shell defining a body configured to surround a substantial entirety of the second terminal ends when mounted to the housing, the protective shell including at least one leg configured to extend through the housing and be received by a complementary aperture extending into the electrical component, the protective shell conductively isolated from the support mounts when the support mounts and the protective shell are mounted to the housing.

16. The electrical connector assembly as recited in claim 15, wherein opposed front and rear contact walls extend between the spaced walls of the support mounts.

17. An electrical connector assembly comprising:

a housing including a pair of mounting supports;

a plurality of electrical contacts supported by the housing, the electrical contacts configured to be connected to electrical traces of an electrical component;

a protective shell defining a body having a perimeter sized to surround at least a portion of the plurality of electrical contacts, the protective shell including at least one leg configured to be received in a complementary aperture in the electrical component when the protective shell is mounted onto the housing; and a support mount housing including a front contact wall, a rear contact wall, and a pair of support mounts configured to be vertically mounted onto respective ones of the mounting supports, each support mount including:

opposed front and rear support mount walls configured to engage corresponding front and rear mounting support walls of a respective one of the mounting supports;

an electrically conductive tab configured to contact the protective shell when the protective shell and the support mount are mounted onto the housing; and an extension configured to be disposed in the electrical component when the electrical contacts are connected to the electrical traces of the electrical component, wherein the front contact wall connects the front support mount walls to one another and the rear contact wall connects the rear support mount walls to one another.

18. The electrical connector assembly as recited in claim 17, wherein at least one of the front or rear contact wall defines a protrusion configured to contact the protective shell.

19. The electrical connector assembly as recited in claim 17, wherein the front and rear contact walls each define at least one protrusion configured to contact the protective shell.

* * * * *